US011684942B2

(12) United States Patent
Sollberger et al.

(10) Patent No.: US 11,684,942 B2
(45) Date of Patent: Jun. 27, 2023

(54) THERMAL SPRAY CABIN WITH SUCTION SYSTEM

(71) Applicant: OERLIKON METCO AG, WOHLEN, Wohlen (CH)

(72) Inventors: Alexander Sollberger, Aarau (CH); Jakob Matthias Handte, Bottighofen (CH)

(73) Assignee: OERLIKON METCO AG, WOHLEN, Wohlen (CH)

( * ) Notice: Subject to any disclaimer, the term of this patent is extended or adjusted under 35 U.S.C. 154(b) by 0 days.

(21) Appl. No.: 16/766,475

(22) PCT Filed: Nov. 23, 2018

(86) PCT No.: PCT/EP2018/082433

§ 371 (c)(1),
(2) Date: May 22, 2020

(87) PCT Pub. No.: WO2019/101959

PCT Pub. Date: May 31, 2019

(65) Prior Publication Data

US 2020/0376514 A1 Dec. 3, 2020

Related U.S. Application Data

(60) Provisional application No. 62/590,419, filed on Nov. 24, 2017.

(51) Int. Cl.
*B05B 14/45* (2018.01)
*B05B 13/04* (2006.01)
(Continued)

(52) U.S. Cl.
CPC ..... *B05B 16/60* (2018.02); *B05B 7/20* (2013.01); *B05B 7/22* (2013.01); *B05B 13/0431* (2013.01); *B05B 14/45* (2018.02)

(58) Field of Classification Search
USPC ..... 118/308, 309, 326, 634, 50, 323, 321, 118/300, 302; 454/49, 50, 51, 53;
(Continued)

(56) References Cited

U.S. PATENT DOCUMENTS 5,165,969 A * 11/1992 Barlett ..... F26B 23/022 427/483
5,326,399 A 7/1994 Takamura
(Continued)

FOREIGN PATENT DOCUMENTS

BY 20290 8/2016
CN 1068280 1/1993
(Continued)

OTHER PUBLICATIONS

China Office Action conducted in counterpart China Appln. No. 20180086249.5 (dated Aug. 25, 2021) w/ Translation.
(Continued)

*Primary Examiner* — Yewebdar T Tadesse
(74) *Attorney, Agent, or Firm* — Greenblum & Bernstein, P.L.C.

(57) ABSTRACT

A thermal spray cabin comprising a table to hold a part to be coated and a robot with a robot body and an arm, a spray gun mounted on the arm of the robot, a ventilation system comprising an air inlet and a suction hood designed to create a gas flow with a main stream from the air inlet to the suction hood thereby passing the table in an operating state of the thermal spray cabin. The air inlet, the table, the robot and the suction hood are arranged in such a way, that the robot body is positioned outside the main stream of the gas flow in the operating state.

11 Claims, 4 Drawing Sheets

(51) Int. Cl.

| | |
|---|---|
| ***B05B 15/60*** | (2018.01) |
| ***B05B 16/60*** | (2018.01) |
| ***B05B 7/20*** | (2006.01) |
| ***B05B 7/22*** | (2006.01) |

(58) Field of Classification Search
USPC ..... 55/DIG. 46
See application file for complete search history.

(56) References Cited

U.S. PATENT DOCUMENTS

| | | | | |
|---|---|---|---|---|
| 6,024,796 | A * | 2/2000 | Salazar | B05B 14/46 118/326 |
| 6,060,117 | A | 5/2000 | Pergande | |
| 2002/0153117 | A1* | 10/2002 | Allor | C23C 4/185 164/46 |
| 2013/0042805 | A1 | 2/2013 | Shutic | |
| 2013/0122206 | A1 | 5/2013 | Ahmed et al. | |
| 2018/0161797 | A1* | 6/2018 | Volonte | B05B 14/48 |
| 2019/0329284 | A1* | 10/2019 | Saito | B05C 11/10 |

FOREIGN PATENT DOCUMENTS

| | | | |
|---|---|---|---|
| CN | 106521400 | | 3/2017 |
| CN | 206139357 | | 5/2017 |
| EA | 22538 | | 1/2016 |
| EP | 0 984 073 | | 3/2000 |
| JP | H0541155 | | 2/1993 |
| JP | 200087205 | | 3/2000 |
| JP | 2006-239587 | | 9/2006 |
| JP | 2012017486 | | 1/2012 |
| JP | 2014167171 | A * | 9/2014 |
| JP | 2017-075353 | | 4/2017 |
| RU | 2510886 | | 4/2014 |

OTHER PUBLICATIONS

China Search Report conducted in counterpart China Appln. No. 20180086249.5 (dated Aug. 17, 2021).
Int'l Search Report (Form PCT/ISA/210) conducted in Int'l Appln. No. PCT/EP2018/082433 (dated Feb. 12, 2019).
Int'l Written Opinion (Form PCT/ISA/237) conducted in Int'l Appln. No. PCT/EP2018/082433 (dated Feb. 12, 2019).
Russia Office Action conducted in counterpart Russia AppIn. No. 2020119239/05 (dated Dec. 30, 2021) w/ Translation.
Russia Search Report conducted in counterpart Russia Appin. No. 2020119239/05 (dated Dec. 30, 2021) w/ Translation.
Japan Office conducted in counterpart Japan Appln. No. 2020-528097 (dated Sep. 16, 2022) w/ Translation.

* cited by examiner

THERMAL SPRAY CABIN WITH SUCTION SYSTEM

Thermal spray processes, such as plasma spraying, high velocity oxygen fuel (HVOF), wire arc spraying, flame spraying, among others, are deposition technologies by feeding a feedstock material such as powders, suspensions or wires at a heat source, which will be completely or partially melted and forming droplets that are accelerated onto the surface of a substrate to form a dense or porous layered coating from splats.

These processes are very loud due to the nature of the heat source, for example the sound produced by an arc discharge between two electrodes or the combustion of gases inside the gun, but also from the high gas velocities exiting the gun through a nozzle. Additionally, these processes produce intrinsically a certain amount of overspray coming from the not uniform melting of the feedstock material due to the temperature gradients of the process gases in which the feedstock material is injected. These particles which are not deposited on the substrate should be directed in a dust collector system.

Most of the thermal spray processes are operated inside a sound insulating cabin which is also confining the overspray produced during the spraying process inside the cabin often as well called booth. However, since the generation of overspray is quite high, the particles need to be collected by means of a dust collection system which generally comprises an air inlet at, a suction hood, a propeller to suck the air off the cabin, a pipe to transport the dust outside of the cabin, a filter system and a dust collection container.

The main challenge of designing an ideal suction system is to maximize the removal of the dust and overspray during the coating process, mainly due to the following reasons:

- Overspray particles could recirculate in the cabin and be re-deposited on the part producing a coating having impurities and unwanted unmolten particles. Impurities could be originating from previous spraying process where different materials were used.
- Some feedstock material contains different types of metals which could become a health hazard if smaller dust particles are produced during the thermal spray process
- An insufficient or not optimized ventilation could generate some localized accumulation of dust particles inside the spraying booth and become a safety hazard, such as combustion dust fire and explosion hazard or even having slippery floors due to the fine dust particles.
- An insufficient suction system could allow the dust or particles to accumulate on the walls and the floor and through strong turbulence let some powder accumulate in more difficult localization inside the booth, increasing the time of cleaning during the maintenance of the machine.

STATE OF THE ART

Typical suction systems used for thermal spraying are industrial ventilation systems which are integrated in the spray booths and consist of

- an air inlet usually localized on the top-back of the cabin, behind the robot used as gun manipulator
- the suction hood itself is placed in front of the cabin which is a box connecting the inside of the cabin through an opening delimited by a grid and/or system of fins and having a pipe usually connected on the top of the box sucking the air away from the cabin towards a powerful fan that is producing the movement of the air from the cabin to the outside world.
- a system of fins or grid to locally increase the suction effect and broaden the air flow on a larger surface. The fin system at the opening of the suction hood is placed in front of the part to be coated. The gun is pointing towards the part to be coated and at the same time towards the suction hood, in order to maximize the collection of dust during the spraying process.

One of the main throwbacks of such a design is that the air flowing from the inlet to the suction system is going through the robot arm diagonally from the top-back to the front-bottom, along the spraying axis, generating strong turbulences around the robot and on the bottom-back side of the chamber where no air is directly flowing. Moreover, the air which is flowing diagonally from the back to the front will eventually bounce on the floor before to reach the suction system. These combined effects will generate a lot of turbulences and reduce the effectiveness of the air flow.

Another limitation comes from the use of the fins or grid in front of the suction hood. Even if the fins are meant to increase the area of the effective air flow in front of the hood, the impact of the suction is optimum only at a distance from the suction hood that is about equal to two times the space between the fins, which is rather a limiting factor as the gas flow from the gun has to be pointing exactly in the collection area of the suction hood. The fins are typically of triangular shape and aligned vertically to each other. The triangular form allows the air to flow around the fins without producing strong turbulences. However, the still hot particles coming from the gun towards the suction hood will be collected on these fins, especially when the gun is in a standby position. The consequence is that particles are starting to produce a deposit having a form of a horizontal "stalactite" and hot powder or dust are being deposited on the walls of the fins or grid at the suction hood. This situation is not favorable for the maintenance process and increases the areas where powder has to be cleaned off the walls especially at the suction hood and on the walls of the fins.

Despite the use of vertically aligned fins to increase the area of effect of the suction hood, the maximum of air flow is located on top of the hood where the external suction pipe is attached on the box. The suction area might be distributed on a larger area thanks to the addition of vertically aligned fins, but the air is not homogeneously distributed since there will be a difference in the velocity of the air between the top and bottom of the hood. This will be the source of small turbulences at the suction hood which will produce a less effective suction system of the particles over the whole area of the suction hood.

A solution to increase the depth of the suction of air from the suction hood at the fins, would be to change the design of the box attached to the suction hood in a way that it accelerates and drives the air in a continuous way out to the suction pipe, like a funnel shape. However, the funnel shaped box would be large compared to the existing compact box attached to the booth, increasing the footprint of the whole system.

Another solution is to use flaps or a gird to deflect the inlet air in such a way that it is no longer going diagonally from the top-back of the booth to the bottom-front, but to flow around on top of the robot. This solution is also not optimum as it will not produce an effective direct air flow between the inlet and suction hood.

Starting from the state of the art it is an object of the invention to propose an improved thermal spray cabin avoiding the disadvantages of the prior art. In particular, the thermal spray cabin shall largely avoid turbulences known from the prior art.

The subject matter of the invention satisfying this object is characterized by the features of the independent claims.

INVENTION

According to the invention a thermal spray cabin is proposed, the thermal spray cabin comprising a table to hold a part to be coated, a robot with a robot body and an arm, a spray gun mounted on the arm of the robot and a ventilation system. The ventilation system having an air inlet and a suction hood designed to create a gas flow with a main stream from the air inlet to the suction hood passing the table in an operating state of the thermal spray cabin. The air inlet, the table, the robot and the suction hood are arranged in such a way, that the robot body is positioned outside the main stream of the gas flow in the operating state.

As a result, in the thermal spray cabin according to the invention the robot body is not in the main stream of the gas flow in the operating state. According to a preferred embodiment the main stream of the gas flow can extend along a straight line drawn from at least one part of the air inlet to the table and further to at least one part of the suction hood with the line not crossing and/or touching the robot body.

The term "in operating state" can, among other things, mean that a gas flow is generated in the thermal spray cabin by the ventilation system, i.e. the ventilation system being active. In particular, "in operating state" can be understood as a process of coating a part in the thermal spray cabin being ongoing.

In contrast to the robot body, the robot arm and the spray gun can be positioned inside the main stream of the gas flow in the operating state.

Especially, the venting system can comprise a suction system having the suction hood on one side and the air inlet opening on the opposite side of a booth (i.e. the thermal spray cabin), that produces a strong, effective and essentially laminar air flow ventilation inside the booth used for thermal spray processes, wherein the effective area and depth of the air flow is distributed homogeneously overall the cross-section of the suction hood; wherein the airflow is traversing through the part to be coated.

Depending on the embodiment variant of the invention, the suction hood is designed to allow a flow between 5000 and 15000 m3/h without the need to modify the diameter of the pipes. It is known that for plasma spray processes, the exchange of the air in the booth must be at least done for a full volume of the booth three times per minute, where typical booth dimensions are about 2.5×5×2.5 m, as an example. For HVOF processes the volume of air to be refreshed has to be higher than for plasma spraying because of the higher energy of the process coming from the combustion of the process gases and the high gas flow. As an illustration, using some specific parameters, HVOF can produce four times more energy (200 kW) than a typical plasma spray parameter (50 KW) and produce a hundred times higher gas flow (1000 NLPM) than plasma gas flows (100 NLPM).

Numerical simulations of transport of dust/particles from the overspray having a typical grain size distribution have shown that the airflow has to have velocities over 4 m/s to be able to transport the particle without dropping on the floor. These high velocities can be reached only if an effective laminar turbulent free air flow is produced between the air inlet opening and suction hood.

In a first preferred embodiment of the apparatus, the suction system comprises a vortex system which produces a circular and/or a spiral motion of the air flow along the vertical axis and inside the vortex system in the operating state which is preferably of a cylindrical shape, wherein the vortex system has an opening along one side of the vortex system to allow the collection of the overspray and/or dust produced during the coating of a substrate by thermal spraying; wherein a suction pipe is connected on the top and/or the bottom of the cylindrical shaped vortex system to allow the air to be extracted effectively and homogeneously from the booth, additionally the air is transported by means of a suction fan downstream towards a filter system and collecting container.

In a second preferred embodiment of the apparatus, the suction hood comprises a large curved shaped collection sheet, in particular a large curved shaped collection metal sheet optimized in such a way that an homogeneous flow of the collected air containing the dust and/or particles is provided, wherein the collection metal sheet has at least partially a smooth surface exposed to the air flow containing the dust and/or particles and the collection metal sheet is an extension of the vortex system at the opening of the vortex system to let the air penetrating inside the vortex system. A laminar flow along the vertical axis and the surface of the curved shaped collection metal sheet produces a homogeneously distributed velocity of air ventilation exposed towards the part to be coated; wherein the effect of the air suction area at the collection metal sheet is penetrating deeper and closer towards the part to be coated in order to collect more effectively the dust and/or particles contained in the air at the proximity of the part to be coated. Another advantageous measure is that the collection metal sheet can be protected by a removable second metal sheet so that it can be quickly replaced when the surface of the sheet becomes dirty from the collected powder particles in order to decrease the maintenance time by avoiding a cleaning of the surface; wherein the material of the collection metal sheet and the additional protective sheet are made of a material, such as Steel or Chrome Plated sheets, and having a surface finish that minimizes the collection and adherence of dust and/or particles on the surface The collecting sheet can be the extension of the vortex system or can alternatively be a separate collecting sheet, which is disposed at the vortex system in order to provide a homogeneous flow of the collected air containing the dust and/or particles.

Another preferred embodiment of the apparatus, the vortex system, in particular of a cylindrical shape, is provided with opening slits aligned vertically along the surface of the vortex system, wherein the opening slits allow an additional air outlet flow penetrating directly inside the vortex system which is additional to the main air inlet coming from the side of the vortex system along the metal curved sheet, The additional slits allow increasing the vortex effect and velocity of the air circulating and/or spiraling inside the vortex system, thus increasing the suction effectiveness and homogeneity of the air transported in front of the whole suction hood system, in particular in front of the collection metal sheet.

In a further advantageous embodiment of the apparatus, the vortex system combined with the collection metal sheet is configured in such a way that it allows the cooling down the hot dust and/or particles not deposited on the part to be coated, which are transported towards the suction hood, so that the hot dust and/or particles are bouncing against the inner walls of the vortex system In another embodiment of the apparatus, the suction hood is aligned with the air inlet opening in such a way that the air flow is traversing the part to be coated and is closely aligned with the direction of the jet of gas, that is the direction defined by the axis from the gun to the part to be coated, within an angle between 0° and 80°, preferably 0° and 45°, and ideally between 0° and 20°, so that with such an alignment the jet of gas containing the dust and/or particles is directed towards the suction hood, in particular towards the collection metal sheet, so that the turbulence from the mixing between the air flow and jet of gas from the gun is minimized.

It is furthermore advantageous that the air inlet opening comprises a grid geometry or flaps geometry to direct the air flow directly towards the suction hood system either horizontally and/or vertically, minimizing the effect of the air flow coming from the air inlet opening to bounce against the floor, ceiling or walls of the booth; wherein the gird and/or flap structure has such a geometry that it will limit the turbulences occurring at the exit of the air inlet opening. Another advantageous geometry is that the grid is made of openings similar to a honeycomb structure; wherein the thickness of the honeycomb structure is chosen in such a way that it will deflect the air flow coming from the air inlet opening through the thicker inner walls of the honeycomb structure so that the air is directed towards the suction hood system. Additionally, the air inlet opening is connected to a box upstream from the air flow; wherein the box has an inner geometry to limit the recirculation of the air flow inside the box and allow a turbulent free air flow to be able to the exit the air inlet opening.

According to another aspect of the invention a method to thermal spray coat a part is proposed. The method comprising the following steps. The part to be coated is positioned on the table of a thermal spray cabin according to the invention/as described above. A gas flow with a main stream from the air inlet to the suction hood is created, the main stream of the gas flow passing the table, wherein a robot body of a robot is positioned outside in the main stream. The spray gun which is attached to the robot arm of the robot is used to coat the part.

According to a preferred embodiment of the method the gas flow has can have a velocity over 4 m/s and/or a flow between 5000 and 15000 $m^3$/h.

Advantageously, the method can further comprise the step of operating the collection sheet by penetrating deeper and closer towards the part to be coated in order to collect more effectively the dust and/or particles contained in air at a proximity of the part to be coated.

Operating the collection sheet can for example be the movement of the collection sheet in a preferable position in order to control the airflow towards the outlet/the suction pipe.

The invention will be explained in more detail hereinafter with reference to the drawings. There are shown in a schematic representation:

Figure 3:
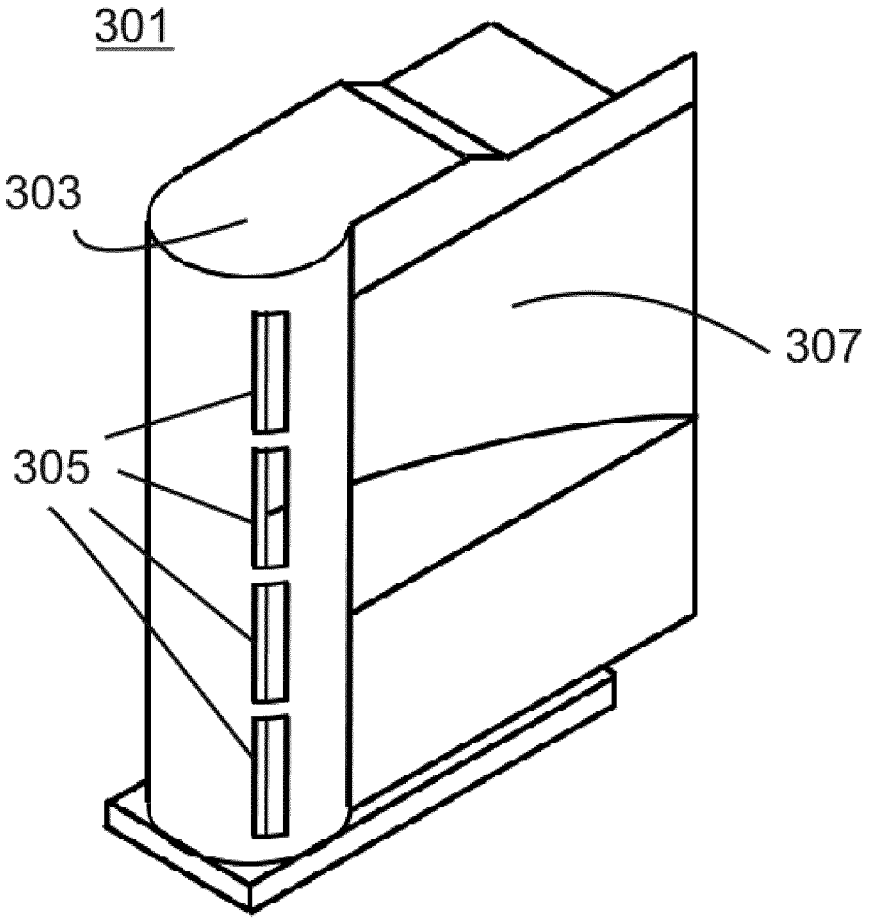
FIG. 3 shows the suction hood, comprising the vortex system, the collection metal sheet and opening slits.
Figure 4:
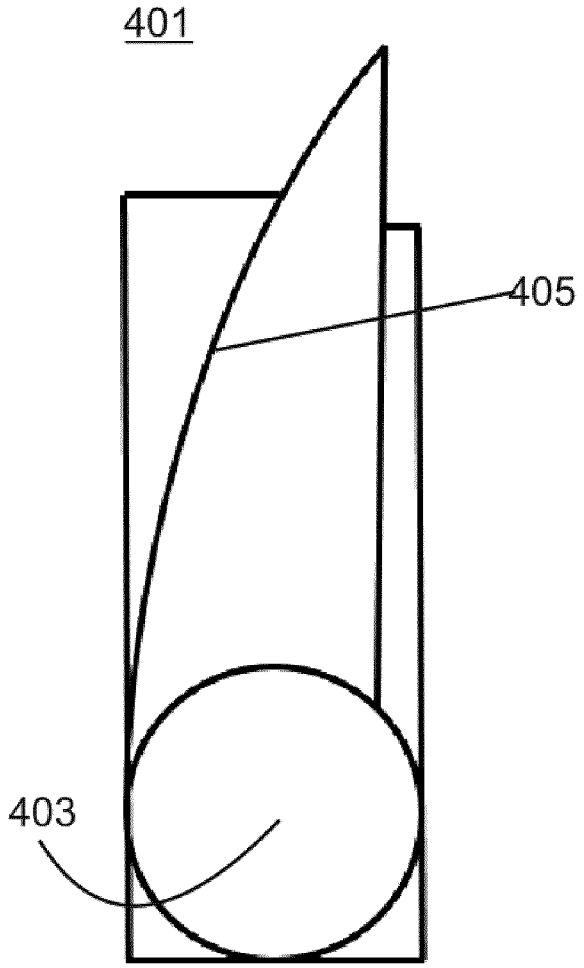

FIG. 4 Top view of the suction hood of FIG. 3.

Figure 1:
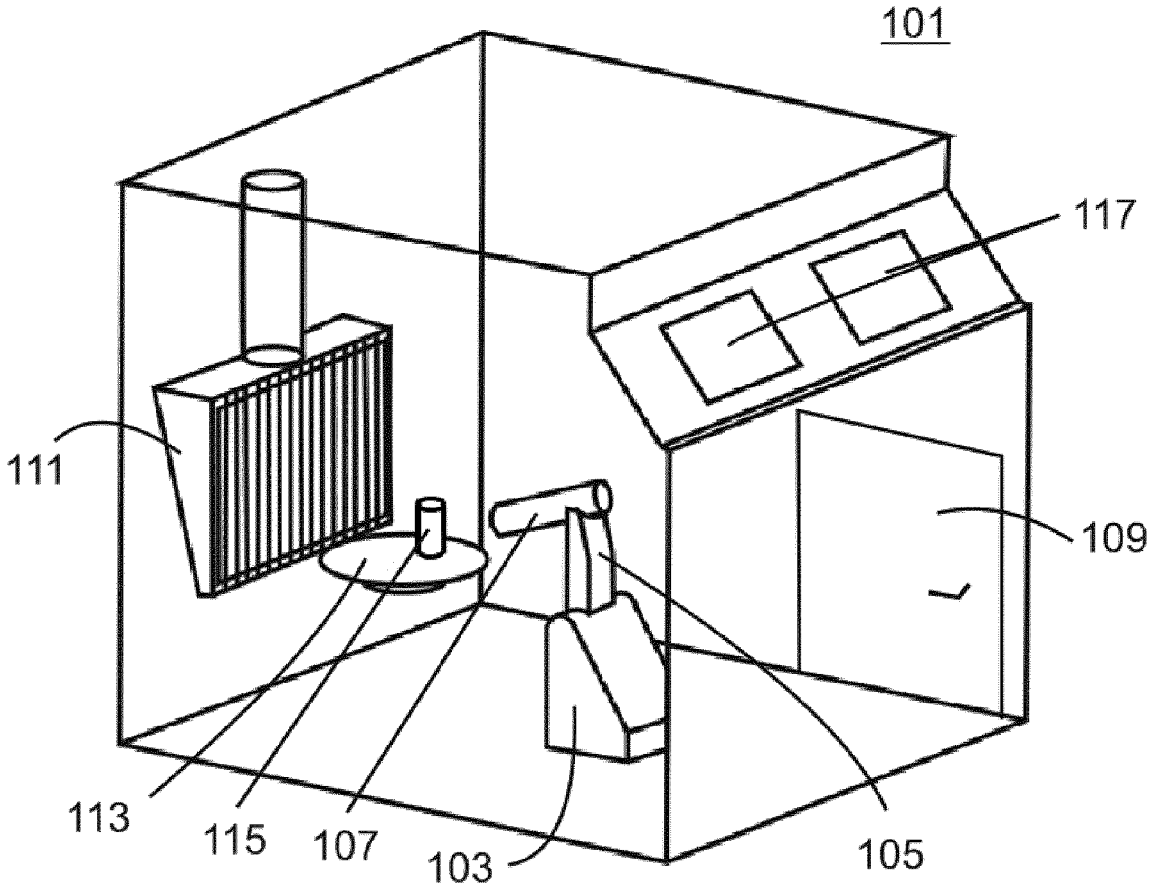
Prior Art Fig. 1
FIG. 1 shows a cabin according to prior art.

FIG. 1 shows a cabin according to prior art. The booth 101 of the prior art comprises a suction hood 111, a table 113 with a part to be coated 115 deposited thereon. Furthermore, the booth 101 comprises a robot 103 with a spray gun 107 attached to a robot arm 105 for coating the part 115, an air inlet 117 and a door 109.

The part to be coated 115 can be inserted into the booth 101 via the door 109. In the operating state a gas flow is generated through ventilation of the suction hood 111. Thereby, an air inlet flow is entering the air inlet 117, producing a gas flow towards the suction hood 111.

In the cabin according to the prior art the robot 103 with a robot body and the robot arm 105 is positioned inside the gas flow from the air inlet 117 towards the suction hood 111. As a result, strong turbulences are generated around the robot and on the bottom-back side of the chamber no air is directly flowing in the operating state, thereby causing all the disadvantages described above.

Figure 2:
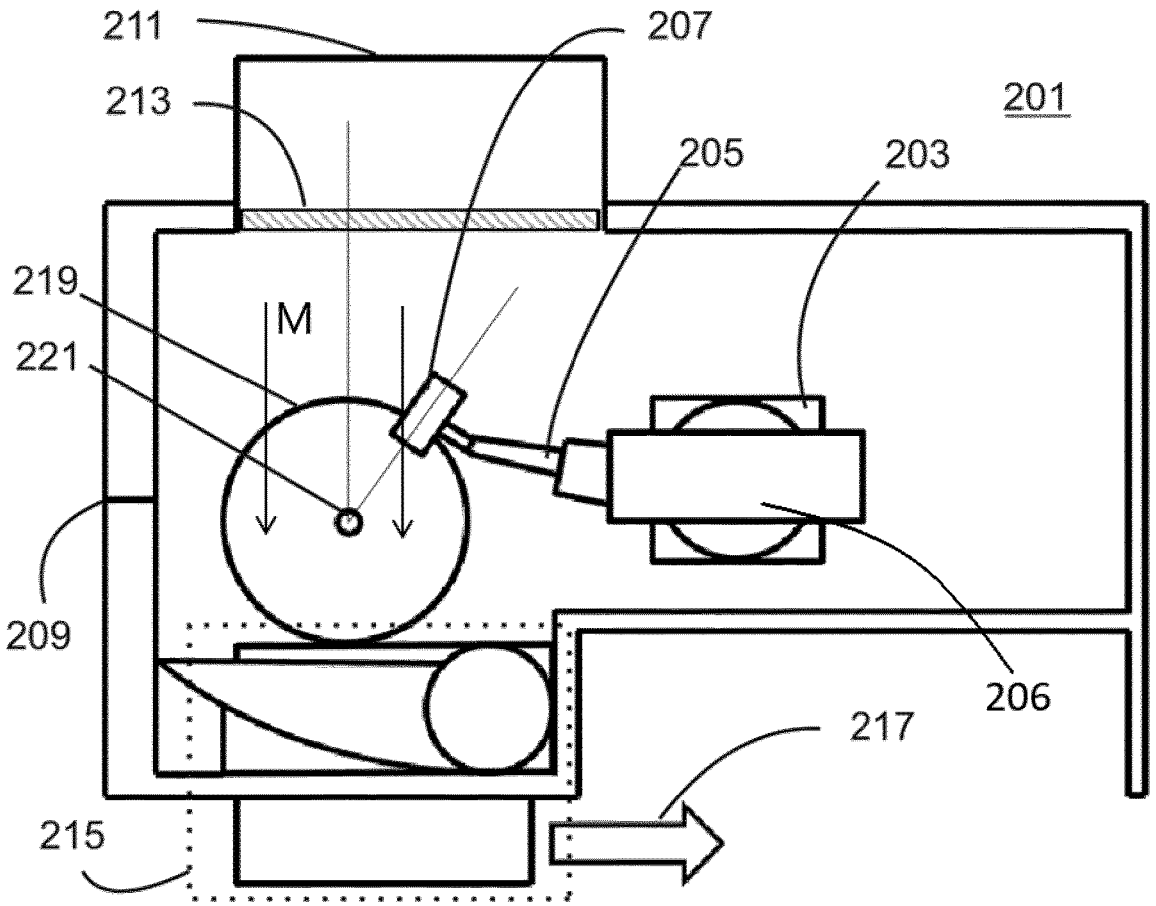
FIG. 2 shows the global view of the thermal spray cabin.

FIG. 2 shows the global view of the thermal spray cabin 201, comprising a table 219 to hold a part to be coated 221 and a robot 203 with a robot body 206 and an arm 205, a spray gun mounted on the arm 205 of the robot, a ventilation system comprising an air inlet 213 and a suction hood 215.

In the operating state the suction hood 215 is creating a gas flow with a main stream M from the air inlet to the suction hood 215. This main stream M is passing the table of the thermal spray cabin. The air inlet 213, the table 219, the robot 203 and the suction hood 215 are arranged in such a way, that the robot body 206 is positioned outside the main stream M of the gas flow. As a result, the robot body 206 is not in the main stream M of the gas flow, thereby avoiding turbulences around the robot body 206.

In the thermal spray cabin 201 shown in FIG. 2 the robot body is arranged on the right side of the cabin 201, i.e. on the right side of the main stream M. Of course the robot body 206 can also be arranged on the left side of the main stream M, above the main stream M or under the main stream M, as long as the robot body 206 is arranged outside the main stream M.

In such an arrangement the disadvantages, especially the strong turbulences, known from the prior art can be avoided.

FIG. 3 shows the suction hood 301, comprising the vortex system 303, the collection metal sheet 307 and opening slits 305. The vortex system 303 is directly connected to the curved shaped collecting metal sheet 307 for providing a homogeneous flow of collected air containing the dust and/or particles in the operating state. Therefore, the collecting sheet 307 is an extension of the vortex system 303.

The opening slits 305 are arranged at the cylindrical shaped body of the vortex system 303 to allow an additional air outlet flow (additional to the sheet 307) penetrating directly into the vortex system 303 in the operating state.

The vortex system 303 can furthermore be connected to a suction pipe for producing a circular and/or a spiral motion of an air outlet flow in the operating state.

FIG. 4 shows a top view of the suction hood 401 of FIG. 3 with the vortex system 403 and the collecting metal sheet 405.

Further, at least because the invention is disclosed herein in a manner that enables one to make and use it, by virtue of the disclosure of particular exemplary embodiments, such as for simplicity or efficiency, for example, the invention can be practiced in the absence of any additional element or additional structure that is not specifically disclosed herein.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

REFERENCE LIST

101 booth
103 robot
105 robot arm
107 gun
109 door
111 suction hood
113 table
115 part to be coated
117 air inlet
201 thermal spray cabin
203 robot
205 robot arm
206 robot body
207 gun
209 door
211 air inlet
213 air inlet opening, preferably grid
215 suction hood
217 flow direction to fan, filter and/or collecting container
219 table
221 part to be coated
301 suction hood
303 vortex system
305 secondary air inlet slits
307 collecting metal sheet
401 suction hood
403 vortex system
405 collecting metal sheet

The invention claimed is:

1. A thermal spray cabin comprising:

a table to hold a part to be coated;

a robot with a robot body and an a robot arm;

a spray gun mounted on the robot arm; and a ventilation system comprising an air inlet and a suction hood designed to create a gas flow with a main stream from the air inlet to the suction hood thereby passing the table in an operating state of the thermal spray cabin, wherein the air inlet, the table, the robot and the suction hood are arranged in such a way, that the robot body is positioned outside the main stream of the gas flow in the operating state, wherein the robot arm and the spray gun are positioned inside the main stream of the gas flow in the operating state, wherein the suction hood comprises a cylindrical shaped vortex system, the vortex system being connected to a suction pipe for producing a circular and/or a spiral motion of an air outlet flow in the operating state, and wherein the suction hood further comprises a curved shaped collecting sheet for providing a homogeneous flow of collected air containing dust and/or particles in the operating state.

2. The thermal spray cabin according to claim 1, wherein the suction hood is designed to allow the gas flow to flow between 5000 and 15000 m3/h.

3. The thermal spray cabin according to claim 1, wherein the suction hood is designed to allow the gas flow to flow at a velocity over 4 m/s.

4. The thermal spray cabin according to claim 1, wherein the curved shaped collecting sheet is an extension of the cylindrical shaped vortex system.

5. The thermal spray cabin according to claim 1, wherein the curved shaped collecting sheet is a curved shaped collecting metal sheet.

6. The thermal spray cabin according to claim 1, wherein the cylindrical shaped vortex system comprises opening slits to allow an additional air outlet flow penetrating directly into the cylindrical shaped vortex system in the operating state.

7. The thermal spray cabin according to claim 1, wherein the main stream of the gas flow extends along a straight line drawn from at least one part of the air inlet to the table and further to at least one part of the suction hood with the line not crossing and/or touching the robot body.

8. A method to thermal spray coat a part comprising:

positioning the part to be coated on the table of the thermal spray cabin according to claim 1;

creating the gas flow with the main stream from the air inlet to the suction hood, the main stream of the gas flow passing the table, wherein the robot body of the robot is positioned outside in-the main stream, while the robot arm and the spray gun are positioned inside the main stream in the operating state; and using the spray gun attached to the robot arm of the robot to coat the part.

9. The method according to claim 8, wherein the gas flow has a velocity over 4 m/s.

10. The method according to claim 8, wherein the gas flow has a flow between 5000 and 15000 m3/h.

11. The method according to claim 8, wherein the method further comprises operating the curved shaped collection sheet by penetrating deeper and closer towards the part to be coated in order to collect more effectively the dust and/or particles contained in air at a proximity of the part to be coated.

* * * * *